US005221227A

United States Patent [19]

Michels

[11] Patent Number: 5,221,227

[45] Date of Patent: Jun. 22, 1993

[54] BRASSIERE

[76] Inventor: Dia L. Michels, 532 9th St., SE., Washington, D.C. 20003

[21] Appl. No.: 855,542

[22] Filed: Mar. 20, 1992

[51] Int. Cl.[5] ..... A41C 3/00; A41C 3/02; A41C 3/12

[52] U.S. Cl. ..... 450/1; 450/8; 450/21; 450/60; 450/62; 450/70; 2/73

[58] Field of Search ..... 2/67, 73, 105, 106, 2/115; 450/1, 8, 19, 20, 21, 23, 39, 40, 60, 61, 63, 62, 70, 71, 72, 73, 74, 75, 76, 77, 79, 80, 82, 83, 84, 85

[56] References Cited

U.S. PATENT DOCUMENTS

| | | | |
|---|---|---|---|
| 1,306,595 | 6/1919 | Jerome | 2/110 |
| 1,466,598 | 8/1923 | Panes | 450/77 X |
| 1,494,119 | 5/1924 | Kops | 450/77 X |
| 1,775,365 | 9/1930 | Jones | 450/85 X |
| 1,983,880 | 12/1934 | Reiss | 2/80 |
| 2,881,765 | 4/1959 | Sloate | 450/71 X |
| 3,023,419 | 3/1962 | Strahle | 2/80 X |
| 3,026,227 | 3/1962 | Flagg et al. | 450/40 |
| 3,066,676 | 12/1962 | Kaupp | 450/58 |
| 3,136,317 | 6/1964 | Freedman | 450/60 X |
| 3,146,779 | 9/1964 | Flagg | 450/39 |
| 3,422,818 | 1/1969 | Erteszek | 450/60 X |
| 4,432,364 | 2/1984 | Martini | 450/60 |
| 4,781,651 | 11/1988 | Ekins | 450/79 |

FOREIGN PATENT DOCUMENTS

| | | | |
|---|---|---|---|
| 0593433 | 3/1960 | Canada | 450/39 |
| 692541 | 8/1964 | Canada | 450/39 |

*Primary Examiner*—Andrew M. Falik
*Assistant Examiner*—Jeanette E. Chapman
*Attorney, Agent, or Firm*—Spensley Horn Jubas & Lubitz

[57] ABSTRACT

A supportive brassiere designed for general usage, aerobics or other athletic activities, and/or nursing. The brassiere is designed to provide maximum support of the breasts during activity by holding the breasts separately and snugly while allowing the wearer to move comfortably and breathe freely. It is designed primarily for athletic use among women with moderate-to-large breasts, but it is also suitable for women with smaller breasts. Additionally, because of its adjustable design features, it can function effectively as a nursing brassiere. The invention is designed with an adjustable side closure and strong, individual, under-breast supports. The brassiere includes a pair of soft cups supported from above by adjustable, wide shoulder straps. The pair of soft cups are supported from below by adjustable, soft, inelastic supports, which may be fabric, that allow each cup to be adjusted individually. The brassiere also includes an adjustable closing on the side and a high, soft one-piece back, as well as a wide elastic rib band.

17 Claims, 3 Drawing Sheets

BRASSIERE

BACKGROUND OF THE INVENTION

1. Field of the Invention

The present invention relates to an improved brassiere. In particular, the present invention relates to an improved brassiere useful as a sports brassiere, a nursing brassiere, and as a general purpose brassiere for women with large bust sizes.

2. Description of Related Art

In the United States alone, more than a half million brassieres are purchased each day. Among the various types of brassieres women buy, an increasing number are sports brassieres. More women than ever are leading active lives. The emphasis on reducing body fat, maintaining a strong cardiovascular system, and the heightened public awareness that heart disease affects women with increasing regularity has lead to more and more adult females participating regularly in athletic activities. While numerous athletic brassieres exist, the prior art brassieres provide only minimal support to women with moderate and larger-sized breasts. Brassieres designed for small breasts are commercially successful, yet the number of women left without adequate support is huge. Over one-third (37%) of the U.S. female population wears large-sized apparel (sizes 16 and higher); fully 25% of these women are under age 35. Almost all of these women wear a C or larger cup. Additionally, a significant percentage of the women who wear regular sizes have breasts requiring a C or larger cup.

Aerobics classes, both high and low impact, as well as aerobic walking tend to be attractive to women because they require no previous experience, are usually conducted with the companionship of others, need no more equipment than a pair of sturdy shoes, and can be done regardless of the constraints of inclement weather or darkness.

The goal of an athletic brassiere is to hold the breasts in place. Today's market for athletic brassieres, different in design from most general use brassieres, evolved from the jogging craze of the 1970s. There are a large variety of sports brassieres on the market—yet, strikingly few are geared to the needs of the larger-breasted participant. High impact aerobics for women of cup size C or larger puts this challenge to the test as the tremendous load on the brassiere is not from one primary movement (as in jogging), but from a wide variety of movements, each performed quickly, with rapid motion changes every few seconds. A sports brassiere for aerobics must offer support for vertical motion, support for horizontal motion, extensive freedom of movement for the arms and torso, as well as comfort when doing floor exercises.

Minimizing unwanted lateral and vertical breast movement during vigorous activity not only makes sport participation more enjoyable but protects the delicate connective tissues which support the breasts. The breasts are made up predominately of fatty tissue which insulate and protect the mammary glands and milk ducts. There are no supporting muscles in the breast, further, the ligaments which extend over the breasts are easily stretched and naturally lose some of their support in the aging process. Support is the primary goal; but an effective sports brassiere must also eliminate bouncing, minimize self-consciousness about breast movement, afford ample freedom of movement, allow for chest expansion and respiration, be comfortable and durable.

The design of an effective sports brassiere is truly a structural engineering challenge. There are two basic design principles currently employed in sports brassieres: encapsulation and compression. To compress is to make more compact by pressure. Compression brassieres bind the breasts to the chest wall as one mass. As U.S. Pat. No. 4,311,150 describes the technique, "... the purpose and design of the present invention is to pull the breasts inwardly, and to not to shape the breasts ..." As patent 4,583,544 describes it, "... the construction of the brassiere acts to bind the breasts against the body, rather than molding or shaping them." For women with small breasts, brassieres that firmly squeeze the breasts flatly onto the chest wall can provide sufficient breast restraint to be effective. However, for women with large breasts, a brassiere which compresses the breasts will often fail to effectively restrain the breasts from moving during exercise. Further, such a brassiere can be uncomfortable and even painful to women with large breasts.

To encapsulate is to surround, encase, or protect as if in a capsule. Rather than acting as if the breasts are merely pliable bumps, an encapsulating brassiere firmly holds each individual breast, surrounding each in supportive fabric. Encapsulation confines each breast within a cup- or pocket-like structure and attempts to control the movement of the breasts as two smaller independent masses rather then one large compressed one.

While some encapsulating sport brassieres available have adequate cup design, other design elements in these bras have deficiencies, e.g., thin shoulder straps, no girth adjustability, short back pieces, etc. (these deficiencies are discussed below).

Listed below are the most common problems with brassieres currently available:

1. All-stretch fabrics

A sports brassiere requires a certain amount of stretch in order to allow the wearer to breathe and move comfortably; alternatively, too much stretch can defeat the brassiere's ability to hold the breasts firmly during movement. A significant number of the sports brassieres on the market stretch in every direction in each part of the brassiere(strap, cup, back panel, surrounding elastic, etc.). All-stretch bras can provide support, but, as the breasts begin to move, so does the fabric—a real problem for large-breasted women.

2. Thin shoulder straps

One of the battle scars for the athletic woman (and many large-breasted women, in general) is bright red, indented welts in the shoulders. A tremendous responsibility for support rests on the shoulder straps. The thinner the straps, the more load the straps place on the skin. Intense activity magnifies the responsibility the straps play in shouldering the support of the brassiere. To provide both support and comfort, a brassiere for supporting sizable breasts must have wide shoulder straps. A surprisingly high number of commercially available sports bras have painfully thin (in the ½ inch range) shoulder straps.

3. No girth adjustability

The most popular style of athletic brassiere consists of a wide elastic rib band which wraps around the body and is pulled on over the head. If the girth of the brassiere is perfect for you, and if the elastic does not lose any of its retractability after numerous wearing, and if the elastic does not lose its hold in the wash, and if your body size never changes (from water weight for instance), then these brassieres pose no problem. Unfortunately, this is not the case for many women. A tight fit cuts off circulation and is uncomfortable; a loose fit reduces the support by not holding the breast firmly during activity. Also, if the elastics in the brassiere become stretched, either from multiple wearing or washing, there is no way to make adjustments, so that the brassiere that fits well initially drops in utility as the wearer uses it.

4. No shoulder strap adjustability

A typical woman's brassiere uses one of many available mechanisms to allow the wearer to adjust the length of the shoulder straps. One of the most surprising features of many of the available sports bras is the inability to lengthen or shorten the shoulder straps. As discussed in above, a correct fit is essential to achieving maximum support. Without the ability to adjust the brassiere's fit to the body, you do not have the ability to enhance the level of support. The shoulder straps are a crucial area where fit and comfort must mesh in an intricate balance in order for a brassiere to be both effective and comfortable. The distance between the breasts and the shoulders is not so standard a measurement that a one-size-fits-all approach can be effective.

5. Short back piece

The effectiveness of a brassiere is largely determined by the shoulder straps. The shoulder straps rely on the back piece of the brassiere for their support. If the back piece is a small amount of fabric, barely covering the back, the strap has little to support it—this results in extra stress placed on the shoulders.

6. No separator between cups

Support for the larger women must be by encapsulation if the garment is to be effective and allow for pain-free exercise. In order to achieve this, each breast must be kept "lifted and separated", that is, held firmly in its correct position with as little ability to move (up and down as well as laterally) as possible. As the breasts are not adjoining, a separator between the cups is required for each breast to be held individually in its correct location.

7. Narrow elastic band under cups

The bottom piece of most brassieres is an elastic band, generally called a rib band, which rests under the cups and wraps around the girth of the body. In most general-use brassieres and many athletic brasseries, this band is quite narrow, usually no more than 5/8ths of an inch wide. For the smaller woman, this does not pose a problem since the purpose of the band is simply to rest on the torso holding the brassiere in place. For the larger woman undergoing a rigorous workout, the role of this band is crucial. The purpose of the band is to anchor the brassiere—to affix the brassiere in place and hold it there. As the body moves, the elastic moves on the body. Within minutes, a narrow elastic will move under the breasts completely, totally abandoning the responsibility of holding the brassiere in place against the torso. As a result, the breasts bounce freely.

8. Thin or non-supportive fabric

If the fabric of the brassiere is thin or loose, the brassiere cannot provide adequate support.

9. Hooks in back or front

The most standard closure mechanism for brassieres is a series of hooks and eyes in the back center of the brassiere, or a single hook or column of hooks in the front. Problems with this arrangement include: i) for a hook-in-back brassiere, while it is usually innocuous when the wearer is standing up, it can be very uncomfortable when performing athletic activities laying on the ground, such as sit-ups, judo, or yoga; ii) the hooks get bent out of shape from extensive use and repeated washing, and once bent, it is hard to get them to retain their original shape; in addition, the place of the bend becomes weak, leading to the hook breaking off altogether; iii) finally, a brassiere should be easy to get on and off and easy to adjust while it is being worn—the traditional hook-in-back mechanism requires the brassiere to be put on upside down and backwards, then twisted around the body. Once on, there is no easy way to adjust it short of twisting it back around the body and repeating the process (or soliciting help from someone else). Avoiding this back hook system altogether protects the back of the body from abrasion caused by these metal closures and facilities adjustment of the brassiere. With respect to a front hooking brassiere, such a construction fails to provide for size adjustment as front hooking bras have only an "on" or "off" position. There is insufficient room between the cups to allow for a choice of sizings.

10. Imprecise sizes (e.g., S/M/L)

A brassiere has little chance of supporting the breasts well if it is not the right size for the body. For that reason, brassieres are marketed by two measures: width around the torso (e.g., 32, 34, 36, etc.) and size of the actual breasts (e.g., B, C, D, DD, etc.). For some reason, many brassiere manufacturers have chosen to market sports bras in the more generic Small, Medium, and Large categories. While this may suffice for, say, a medium girth woman with medium size cups, it is clear that a large percentage of the female population requires more precise sizing to achieve maximum support and comfort.

11. Not available in larger than C cup

The overwhelming majority of athletic bras are not offered for the woman with a breast size greater than C; yet there are millions of women who need brassieres in larger sizes.

12. Straps fall off shoulders

Once a brassiere has a good fit and is comfortable to wear, it helps if it stays on the body. The most common place for a brassiere to break away from the body is the shoulder strap. If the straps are too loose, they slide over the shoulder; if the straps are too tight, the brassiere is uncomfortable to wear. Even a well fitting strap can slide off the shoulder if the wearer is engaging in activities utilizing a side-to-side motion. It is for this reason that many brassieres now have straps that criss-cross across the back. Alternatively, non-criss-crossing straps can work effectively if the straps fit close to the neck, coming down toward the center of the back. Nevertheless, many sports bras have straps that come straight down the back and connect to the brassiere closer to the sides of the body than to the middle.

13. Underwire

The best supporting bras lift each breast slightly and hold them lifted while the wearer moves. The most effective way to achieve this lift/hold is with an underwire. However, underwire is not appropriate in a sports brassiere (although a few do exist) as the wire can cause chafing from the constant motion of a sweaty body, can be uncomfortable when doing extensive movement and/or stretching (especially laterally), and tend to break through the fabric casing and poke the wearer. Sports bras tend to forgo the underwire and achieve the lift/hold with very supportive fabrics and elastics. This is perfectly effective for small women, but the amout of elasticity required to lift/hold the breasts for larger-sized women leads to uncomfortable compression.

14. Non-adjustable cups

In reality, most women have one breast that is slightly larger than the other. Some women must procure specially fitted (and more costly) brassieres because their breast size differential is significant. By providing women with the means to adjust each cup individually, a brassiere can more accurately be fitted, ensuring the most comfort and the most support.

SUMMARY OF THE INVENTION

One object of the present invention is to provide a supportive brassiere for the active, larger woman which solves the aforementioned problems. Another object of the present invention is to provide nursing women with heavy/large breasts with a brassiere that affords them function and support.

It is another object of this invention to support the wearer's breasts—holding them stationary, separated, and slightly raised—while still allowing for ease of movement and sufficient chest expansion to permit proper respiration.

It is yet another object to provide an adjustable brassiere with strong under-bust support and a side closure.

It is yet another object of the present invention to provide an athletic brassiere suitable for women of all shapes and sizes, and which is capable of being adapted to an individual woman's body on a given day, taking into consideration the wear and tear of the brassiere, a woman's body weight on a given day, etc.

It is yet another object of the present invention to provide a supportive brassiere with a strong, pliable, supportive back piece which, in addition to encouraging good posture through a high, supportive back piece, is capable of moving with the wearer yet maintaining control across the wearer's back, and which takes stress off the shoulders and shoulder straps by transferring some of the load to the back of the wearer and encouraging the straps to pass over the trapezius muscles near the neck.

It is yet another object of the present invention to provide a brassiere having an elastic, adjustable, snug, wide rib band. Such a band will maintain uniform support across the torso area and providing a solid enough anchor to hold the brassiere in position, avoiding the problems associated with narrow elastic bands under cups discussed above.

The above objects can be achieved in accordance with an embodiment of the present invention using a brassiere having a pair of soft inelastic cups supported from above by adjustable, wide shoulder straps, and from below by adjustable, soft, inelastic supports that allow each cup to be adjusted individually, a wide elastic rib band, an adjustable side closure; and a high, soft one-piece back. The adjustable, soft, inelastic supports under the cups may be made of fabric and function as would an "underwire" support but avoid the above-mentioned problems associated with traditional underwire supports.

The above and other objects and advantages of embodiments of the present invention will be better understood from the description of the preferred embodiment when taken in conjunction with the attached drawings. It is to be understood that the attached drawings are merely illustrative and that the present invention is not intended to be limited by the illustrated embodiments. It is clear that numerous deviations from the illustrated embodiments are possible without departing from the spirit and scope of the present invention as defined by the claims appended hereto.

DESCRIPTION OF THE PREFERRED EMBODIMENT

Figure 1:
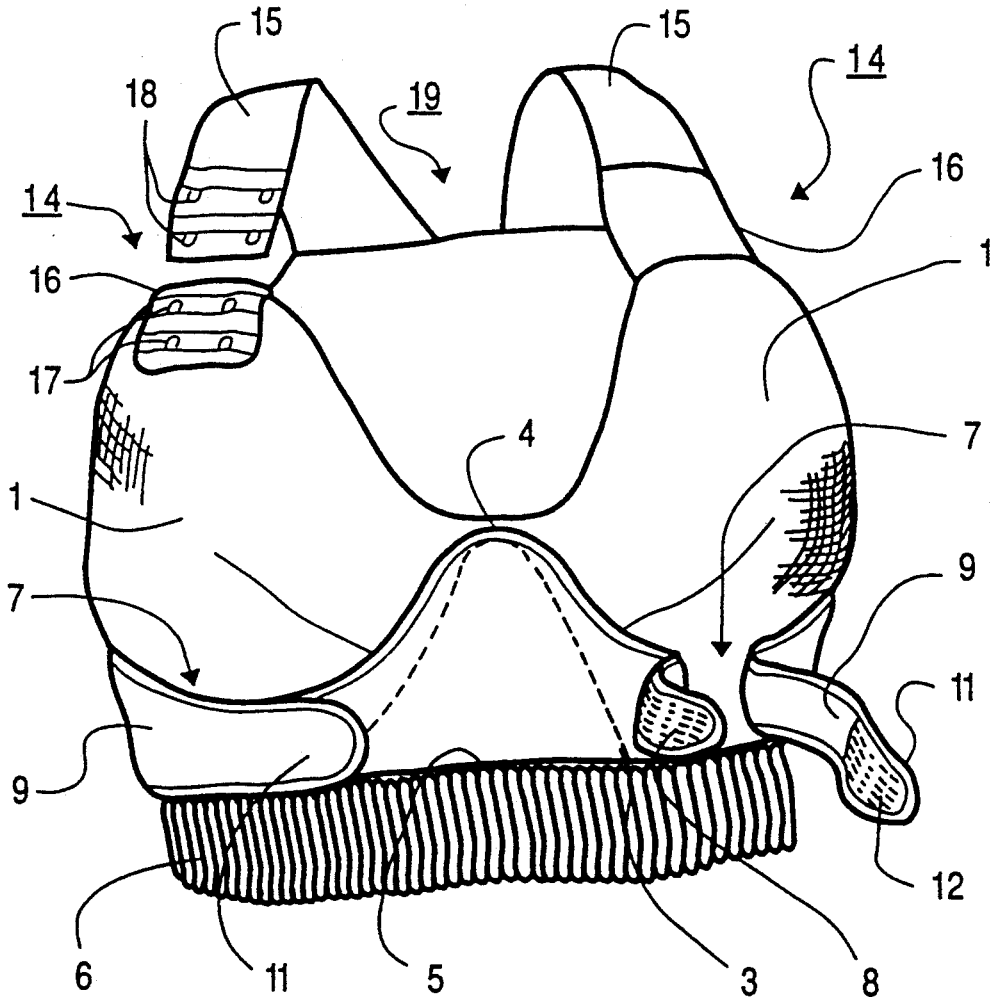
FIG. 1 is a front view of the brassiere in accordance with an embodiment of the present invention.

Referring to FIG. 1, the brassiere has a front panel which includes two individual, soft, supportive non-stretch molded cups, 1, each of which is shaped to comfortably hold a woman's breasts firmly and securely. The cups 1 used in this brassiere are non-stretch and are made of double fabric, i.e., two pieces of fabric laminated together, then molded into the shape of breasts. The inside fabric, which rests against the skin, is made of cotton, chosen for its softness and absorbency. The outer fabric is polyester, chosen for its durability and its ability to hold a molded shape. This combination of fabrics means that the breast are supported by thick, soft, absorbent, durable, pre-shaped cups.

Of course, this combination is not a requirement. A single piece of fabric could be molded into a cup. Another option would be to use one of the new synthetic fabrics that "wick" moisture away from the body. While molded cups minimize the seams required around the breast, and particularly across the nipple, sewn cups could also be used. The prototype cups are white, but various colors could and should be used for further models of this brassiere.

A separator piece 2 (see FIG. 2) which joins and separates the cups, is formed of soft, non-stretch material, e.g. cotton.

A cover piece 3, attached to the front panel made of two layers of stretchable lycra-spandex lace sits on top of the separator piece 2 and connects to the brassiere at the top 4 of the separator piece and at the bottom 5 of the separator piece where the cups 1 connect to the rib band 6. The height of cover in the front center of the brassiere is approximately 3 and ¾ inches. The cover piece 3 tapers on each side, curving with the inverse shape of the breast, so as to form a part of a thinner "belt" portion 7 under the cups with a final height of approximately 1 and ½ inches. Attached to the underside of the last two inches of the "belt" portion 7 on both ends 8 is fastening tape, such as VELCRO. The length of the cover piece 3 from one end 8 of the belt to the other end 8, is approximately 9 to 10 inches. The length will vary depending on the size of the brassiere.

Figure 2:
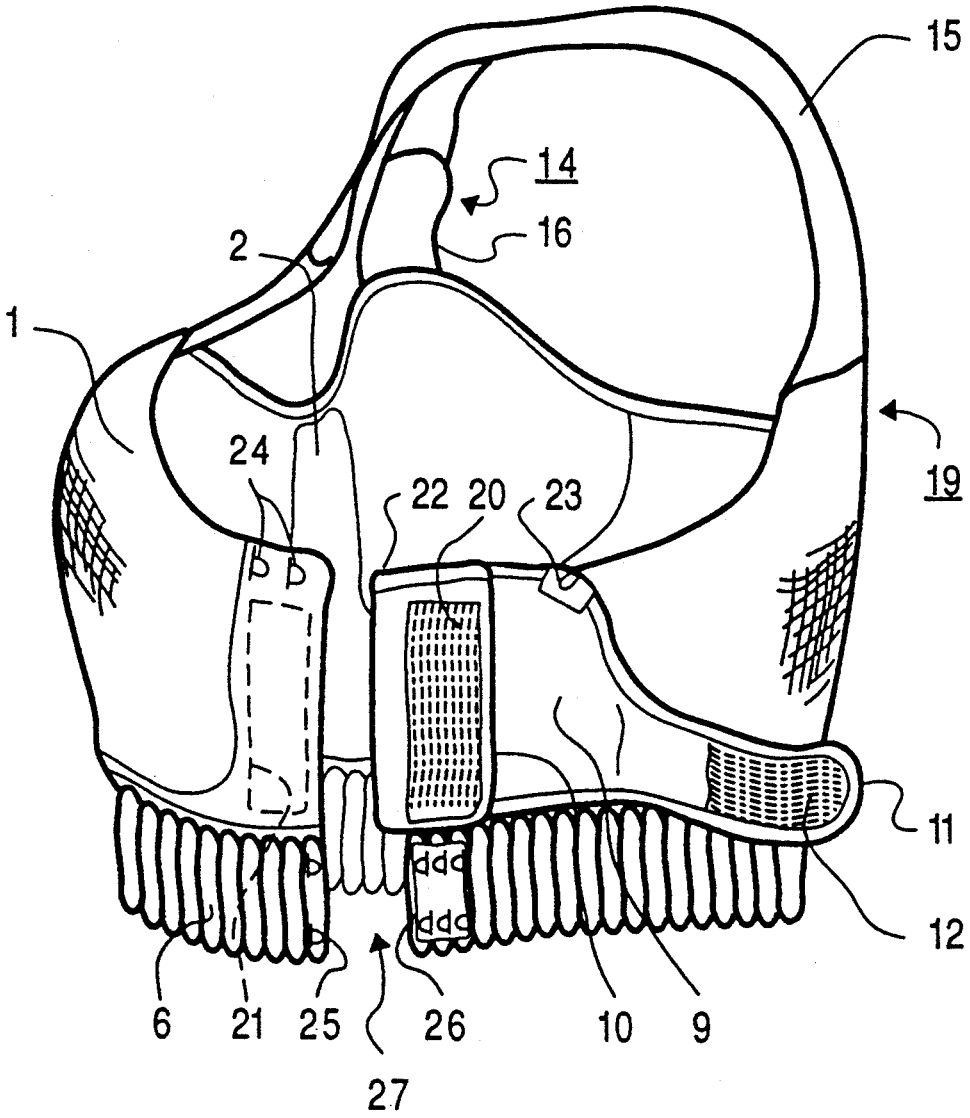
FIG. 2 is a rear view of the brassiere in accordance with an embodiment of the present invention.

Referring to FIG. 2, attached to the side of the brassiere, underneath the arm, are connector pieces 9 also made of two layers of stretchable lycra-spandex lace. The connector pieces begin at the side with a height of approximately 3 and ½ inches and taper down on each side, curving with the inverse shape of the breast so as to form the joining part of the thinner "belt" portion 7 under the cups 1 with a final height of approximately 1 and ½ inches. Attached to the underside of the ends 11 of the connector piece 9 is fastening tape 12. The length of the connector pieces 9 from the side to the ends are approximately 6 to 7 inches. Of course, this length will vary depending on the size of the brassiere. Under the cups, the cover piece 3 joins to the connector pieces 9 with the fastening tape. Each side is joined separately from the other side thus enabling the wearer to customize the under-bust support to the exact dimensions of each breast (a feature that allows each cup to be sized differently for women with non-identical breasts). The joining of the connector pieces 9 to the cover piece 3 under the cups imitates the action of underwire, providing the wearer with adjustable, supportive, fitted belts under each cup that raise the breasts slightly and hold them in a raised position while ensuring a snug fit. These unique belts 7 offer the effectiveness of underwire without actually using any wire.

All edges of the cover piece 3 and the connector pieces 9 are finished with seam bias tape. This finishing not only gives the brassiere a clean edging but serves to stiffen the edges, reinforcing its ability to support the breasts.

While the fastening tape and its associated adjustability made the bands especially useful, the brassiere could also be fashioned with a non-adjustable band that would still function as an underwire but just not allow for the more precise fitting afforded by the fastening tape closure. Alternatively, different closure fittings and locations could be employed. Hooks and eyes or snaps, for instance, could be used; the closure could stay in the center or move to the sides or near the center.

As shown in FIG. 2, a wide, adjustable elastic rib band 6, encircles the body and connects at the left side, under the connector piece 9. The height of the band 6 is approximately two inches. The band 6 is fastened on the left side of the body with hooks 25 and eyes 26 (one set of hooks 25 on the front piece with several sets of eyes 26 on the back piece to allow for proper fitting. The rib band 6 prevents the brassiere from creeping up the torso and lodging under the breasts thus helping to anchor the brassiere to the chest and maintain uniform support. The width of the elastic could vary from the two-inch mentioned above but it is preferred that the band 6 be at least one-and-one-quarter inch in width. Other devices could also be used in the fastening, including flat hooks and eyes (the kind used on men's pants), fastening tape, buttons, snaps, even a small zipper. Further, while the illustrated embodiment shows the rib band 6 being fastened at the left side of the wearer, it should be understood that the band 6 could optionally be made to fasten at the right side of the wearer.

Referring back to FIG. 1, at the top of the cup, is a connector 14 where straps 15 to are joined to the cups 1. Each connector 12 includes a lower piece 16, containing either one or two sets of hooks 17. The lower piece 16 is approximately 1 and ½ to 2 inches in width and height. It is made from two layers of fabric. The outer fabric is the same lycra-spandex lace found in the under-bust support. This lace is placed on a non-stretch, absorbent fabric. The combination ensures that the lower piece has a decorative look from the outside, and that no part of the straps have stretch. The lower piece 16 can be eliminated in its entirety with the hooks 17 placed directly on the tops of the cups, however, this arrangement puts more stress on the cup fabric.

Figure 3:
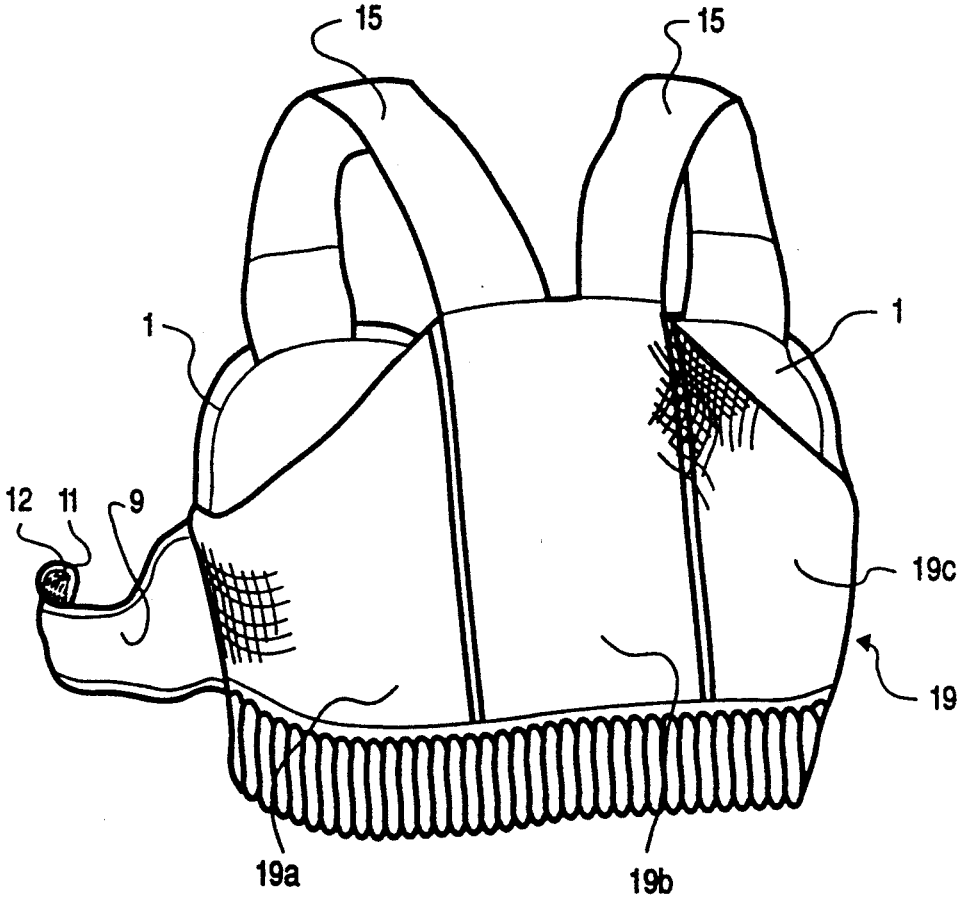
FIG. 3 is a side view of the brassiere in accordance with an embodiment of the present invention.

The shoulder straps 15, which are also approximately 1 and ½ to 2 inches in width, and are constructed from the same combination of lace on the outside and a non-stretch, absorbent fabric on the inside, have a series of eyes 18 that connect to the lower piece 16. As shown in FIG. 3, these wide, soft, non-stretch, adjustable shoulder straps 15 are affixed to the brassiere near the center of the back 19 and hook to the cup in front. Having the straps 15 join to the cups 1 in the front ensures that they can be adjusted both before and after the brassiere has been put on. The hook connectors allow for perfect fit, easy adjustment, and easy access to the breasts for women who are nursing their children. The wideness of straps help spread the weight of the breasts across a wider section of the shoulders and thus minimizes the pressure on the shoulders. Attaching the straps to the brassiere near the center back 19 ensures that they don't fall off the shoulders during movement.

Alternative strap closure mechanisms could be used as well. These include fastening tape, snaps, plastic buckles, and buttons. Alternative strap designs include straps that criss-cross in the back or have a mechanism to attach the straps to each other in the back before they attach to the back of the brassiere to prevent them from slipping off the shoulders (this is occasionally seen in women's swimming suits). The straps could be as narrow as three-quarters of an inch, but at least 1 and ½ inches is preferable.

FIG. 2 illustrates how the brassiere is fastened onto the body, and released from the body. Access is made through a panel on the left side of the brassiere (although it could also be on the right side), under the arm, which can include three closure mechanisms: 1) a vertical fastening tape strip 20, comprised of approximately 1 inch wide piece of fastening tape, fastened to the outer side of the back 19, and extending from the underarm down to the rib band 6. The vertical strip 20 mates with a 1 and ½ inch wide piece of fastening tape 21, fastened to the front of the brassiere which extends from the underarm down to the rib band 6. The fastening tape strips 20, 21 are approximately 4 to 5 inches in length. The vertical strip 21 is wider than the strip 20 to allow the wearer to adjust the fit of the brassiere to achieve whatever snugness is desired. Further, the vertical strips 20, 21 enable the wearer to vary the fit at the top of the closure from that at lower end thereof.

The hook side of the Velcro, which tends to be hard, is disposed, so as to face away from the skin so that the hard fastening tape does not rub against skin. Additionally, a "fly" piece 22 is attached to the back piece next to the fastening tape to protect the body from being rubbed by the fastening tape. Under the arm rests a single hook 23 at the top of the connector piece 9. The hook 23 mates with one of several eyes 24 that are disposed near the junction of the cup 1 and the fastening tape strip 21. The hook 23 and eyes 24 give the wearer one more way to adjust the fit of the brassiere. A set of hooks 25 and several sets of eyes 26 also rest on the rib band 6 below the fastening tape strips 20, 21. The set of hook-s 25 are disposed on the back piece 19, under the fastening tape strip 20, directly on the elastic rib 6. The relative positions of the hooks and eyes can be reversed. The hooks 25 mate with one of the sets of eyes 26 that are disposed at the edge on the rib band 6 below the fastening tape strip 20. The hooks 23 and 25 at the top and bottom of the opening 27 secure the brassiere in place and reduce the chance of the fastening tape strips 20, 21 pulling open.

FIG. 3 illustrates the high, unbroken, smooth, supportive, stretch back panel 19 which assists in maintaining correct posture, protects the back of the body from abrasion caused by traditional metal closures, and loads pressure onto the back and off the shoulders. The height of the back piece, excluding the rib band 6, is approximately 6 and ½ to 7 and ½ inches. The back panel 19 extends from a few inches above the waist to a few inches below the nape of the neck of the wearer.

The back panel 19 of this brassiere is constructed of multiple layers of fabric. Elastic stretch fabrics are used so that the wearer can both move comfortably and have firm support across the upper body. In one embodiment of the present invention, the brassiere back panel consists of three sections 19*a*, 19*b*, 19*c*. The outer fabric in each section 19*a*–19*c* is the same lycra-spandex lace used in the front. This lace offers both control and attractiveness. The inner fabric, cut identically to the lace, is a cotton lycra fabric; the lycra adds stretch and control, while the cotton is both soft and adsorbent. Additionally, between sections 19*a*–19*c* is a center section 19*b*, approximately four inches across, which includes a non-stretch fabric sewn between the cotton and lace fabrics. This panel 19*b* serves at least two purposes. First, it reduces the overall stretch of the back panel, moving the stretch toward the side areas of the back portion. Secondly, it helps support the shoulder straps 15. Both shoulder straps 15 connect to the back 19 to the non-stretch panel 19*b*. As a result, the shoulder straps 15 do not pull on the stretch fabric panels 19*a*, 19*c*, which could cause movement of the back panel 19. For example, the back 19 would tend to move toward the shoulders each time the arms are raised.

Other back constructions could also be used. In earlier prototypes, a lycra mesh fabric, doubled over, was used instead of the lace/cotton, for a more athletic look (the lycra mesh can be used in all places the lace is used). A thick, supportive, wicking fabric could be used instead of using two separate fabrics. The middle panel could be eliminated altogether if the amount of stretch in the back fabric is reduced or if more stretch is desired.

What is claimed is:

1. A brassiere comprising:

a front panel including first and second breast-receiving cups, a separating member for joining and separating the first and second cups, a cover attached to the front panel, a back panel extending across a back of a wearer, first support means, attached to the back panel and adjustably attached to the cover, for individually shaping and supporting the first cup, the first support means comprising a non-stretch material, second support means, attached to the back panel and adjustably attached to the cover, for individually shaping and supporting the second cup, the second support means comprising a non-stretch material, and first and second shoulder straps attached to the back section and adjustably attached to the front section of the brassiere wherein the first and second support means act in conjunction with the cover to provide a function similar to an underwire while also being individually adjustable.

2. A brassiere according to claim 1, at least one of the first and second shoulder straps is removably attached to the front section.

3. A brassiere according to claim 1, the first and second shoulder straps comprise a non-stretch material.

4. A brassiere according to claim 1, further comprising:

closure means for adjustably attaching the front panel to the back panel, the closure means being positioned at a side of the wearer.

5. A brassiere according to claim 4, the closure means is located substantially halfway between the separating member and a center of the back panel.

6. A brassiere according to claim 4, the closure means comprises first and second fastening strips, the first fastening strip being disposed on the front panel of the brassiere and the second fastening strip being disposed on the back panel of the brassiere.

7. A brassiere according to claim 6, the first fastening strip is wider than the second fastening strip.

8. A brassiere according to claim 6, the closure means comprises a first hook and eye closure mechanism disposed at a position below the first and second fastening strips.

9. A brassiere according to claim 8, the closure means comprises a second hook and eye closure mechanism disposed at a position above the first and second fastening strips.

10. A brassiere according to claim 6, the closure means comprises a hook and eye closure mechanism disposed at a position above the first and second fastening strips.

11. A brassiere according to claim 1, the back panel comprises first, second and third sub-sections, the first and third sub-sections comprising elastic stretch fabrics, and the second sub-section being comprising at least one layer of non-stretch fabric.

12. A brassiere according to claim 11, the first and second shoulder straps are attached to the second subsection.

13. A brassiere according to claim 1, further comprising an elastic rib band attached to the front and back panels of the brassiere, the rib band extending about a torso of the wearer.

14. A brassiere according to claim 13, the rib band comprises first and second end portions, the first end portion being removably connectable to the second end portion.

15. A brassiere according to claim 14, the rib band comprises coupling means for coupling the first end portion to the second end portion.

16. A brassiere according to claim 15, the coupling means comprises a hook and eye closure mechanism.

17. A brassiere according to claim 1, a fastening strip adjustably attaches the first and second support means to the separating member.

* * * * *